US009272438B2

(12) United States Patent
Amend et al.

(10) Patent No.: US 9,272,438 B2
(45) Date of Patent: Mar. 1, 2016

(54) GUIDE BAR HAVING A CARBON FIBER REINFORCED PLASTIC INSERT

(71) Applicant: Andreas Stihl AG & Co. KG, Waiblingen (DE)

(72) Inventors: Helmar Amend, Ludwigsburg (DE); Christoph von Hiller, Stuttgart (DE); Alexander Fuchs, Bietigheim-Bissingen (DE); Christine Rominger, Stuttgart (DE); Matthias Schulz, Freiberg am Neckar (DE); Jonas Lank, Winnenden (DE); Klaus-Martin Uhl, Plochingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 178 days.

(21) Appl. No.: 14/198,306

(22) Filed: Mar. 5, 2014

(65) Prior Publication Data

US 2014/0250701 A1 Sep. 11, 2014

(30) Foreign Application Priority Data

Mar. 5, 2013 (DE) ..... 10 2013 003 643

(51) Int. Cl.
*B27B 17/02* (2006.01)

(52) U.S. Cl.
CPC ..... *B27B 17/025* (2013.01)

(58) Field of Classification Search
CPC ..... B27B 17/02; B27B 17/025
USPC ..... 76/25.1, 101.1, 112; 83/821; 30/381–387, 123.4
See application file for complete search history.

(56) References Cited

U.S. PATENT DOCUMENTS 1,342,213 A * 6/1920 Hanson et al. ..... B27B 17/0083 30/384
2,165,524 A * 7/1939 Wolf ..... B27B 17/0008 30/387
2,532,981 A * 12/1950 Wolfe ..... B27B 17/02 30/385
2,962,061 A * 11/1960 Nielsen ..... B27B 17/02 76/112
3,119,418 A * 1/1964 Rayniak ..... B23K 1/0008 30/387
3,250,304 A * 5/1966 Merz ..... B27B 17/02 30/387

(Continued)

FOREIGN PATENT DOCUMENTS

CA 2342005 A1 * 2/2002
CH 227832 A * 7/1943

(Continued)

*Primary Examiner* — Jason Daniel Prone
(74) *Attorney, Agent, or Firm* — Walter Ottesen P.A.

(57) ABSTRACT

A guide bar for a chain saw has an elongate main body of steel. The main body has flat sides and upper and lower peripheries defining a guide groove for a saw chain. An elongate window is formed in the main body between the peripheries and is filled with an insert made of a fiber composite material made up of resin and fibers. The fibers are in the direction of the longitudinal axis of the main body. The insert includes a plurality of fiber layers that are bonded with resin. A central layer is formed from a fiber layer and the fibers thereof are at an angle to the longitudinal axis. Two fiber layers having fibers oriented in the direction of the longitudinal axis of the main body are on both sides of the central layer. The inner fiber layers are covered outwardly by a woven fabric.

15 Claims, 3 Drawing Sheets

(56) References Cited

U.S. PATENT DOCUMENTS 3,416,578 A * 12/1968 Irgens ..... B27B 17/025 30/387
3,473,581 A * 10/1969 Merz ..... B27B 17/025 30/387
3,485,276 A 12/1969 Font
3,545,505 A * 12/1970 DeWesse ..... B27B 17/025 83/821
3,949,475 A * 4/1976 Tokarz ..... B27B 17/02 30/387
4,334,358 A * 6/1982 Reynolds ..... B27B 17/0033 30/387
4,373,265 A * 2/1983 van Halderen ..... A01G 23/099 30/383
4,393,590 A 7/1983 Pantzar
4,693,007 A * 9/1987 Apfel ..... B27B 17/025 30/383
4,885,843 A * 12/1989 Kelsay, III ..... B27B 17/12 30/387
4,903,410 A 2/1990 Wieninger et al.
4,961,263 A 10/1990 Apfel et al.
5,014,435 A * 5/1991 Date ..... B27B 17/025 30/383
5,025,561 A * 6/1991 Sugihara ..... B27B 17/025 30/383
5,035,058 A * 7/1991 Date ..... B27B 17/12 30/383
5,067,243 A * 11/1991 O'Neel ..... B27B 17/025 30/383
5,216,814 A * 6/1993 McGregor ..... B27B 17/12 30/387
5,249,363 A 10/1993 Mitrega et al.
5,271,157 A * 12/1993 Wieninger ..... B27B 17/025 30/383
5,634,273 A * 6/1997 Michels ..... B27B 17/025 30/383
5,669,140 A * 9/1997 Tsumura ..... B27B 17/12 30/383
5,685,080 A * 11/1997 Amano ..... B27B 17/08 30/383
5,735,259 A * 4/1998 Hoerner ..... B27B 17/025 125/21
5,842,279 A 12/1998 Andress et al.
5,884,406 A * 3/1999 Leini ..... B27B 17/025 30/383
6,138,339 A * 10/2000 Escher ..... B27B 17/025 76/112
6,397,475 B1 * 6/2002 Pettersson ..... B27B 17/12 30/383
6,427,342 B1 8/2002 Breitbarth et al.
6,643,933 B2 * 11/2003 Seigneur ..... B27B 17/025 30/123.4
6,698,101 B2 * 3/2004 Chen ..... B27B 17/025 30/383
6,964,101 B2 * 11/2005 Graves ..... B27B 17/025 30/383
7,818,886 B1 * 10/2010 Grindstaff ..... B27B 17/02 30/383
8,225,515 B2 * 7/2012 Ruth ..... B27B 17/02 30/383
8,661,695 B2 * 3/2014 Hermansen ..... B27B 17/025 30/383
8,869,787 B2 * 10/2014 Tholking ..... B27B 17/02 30/382
2004/0111897 A1 6/2004 Graves et al.
2008/0244915 A1 * 10/2008 Ruth ..... B27B 17/025 30/387
2010/0037472 A1 * 2/2010 Lucas ..... B27B 17/02 30/383
2011/0010952 A1 * 1/2011 Galster ..... B27B 17/02 30/387
2011/0192039 A1 * 8/2011 Fuchs ..... B27B 17/025 30/383
2012/0176806 A1 7/2012 Baratta
2013/0031793 A1 * 2/2013 Baratta ..... B27B 17/025 30/387
2015/0047491 A1 * 2/2015 Schamberg ..... B27B 17/02 30/383
2015/0052762 A1 * 2/2015 Fuchs ..... B27B 17/025 30/387

FOREIGN PATENT DOCUMENTS

DE 572745 C * 3/1933
DE 728639 C * 12/1942
DE 850803 C * 9/1952
DE 1113173 B * 8/1961
DE 1136812 B * 9/1962
DE 3607010 A1 * 9/1987
DE 3730171 A1 * 3/1989
DE 19648437 A1 * 5/1998
DE 29823082 U1 * 11/1999
DE 102013003643 A1 * 9/2014
EP 2774732 A1 * 9/2014
FR 972531 A * 1/1951
FR 1450970 A * 6/1966
GB 578826 A * 7/1946
JP 01105702 A * 4/1989
JP 05309604 A * 11/1993
JP 06055503 A * 3/1994
JP 06297403 A * 10/1994
JP 2583726 B2 * 2/1997
SU 406725 A1 * 11/1973
SU 1131666 A1 * 12/1984

* cited by examiner

GUIDE BAR HAVING A CARBON FIBER REINFORCED PLASTIC INSERT

CROSS REFERENCE TO RELATED APPLICATION

This application claims priority of German patent application no. 10 2013 003 643.7, filed Mar. 5, 2013, the entire content of which is incorporated herein by reference.

BACKGROUND OF THE INVENTION

Such a guide bar for a chainsaw is known from U.S. Pat. No. 4,903,410. The guide bar is made of a one-part, elongate main body made of steel, on the opposite circumferential peripheries of which a guide groove for the engagement of drive links of a saw chain is formed. The main body has a connection section to be secured to the chainsaw, and a bar tip which serves to return the saw chain circulating on the guide bar. Provided in the main body is a cutout in the form of an elongate window, which extends from the connection section as far as the bar tip between the circumferential peripheries of the guide rail. The window in the guide bar is filled with an insert made of a fiber composite material which can be made of resin-saturated fiber layers.

A guide bar, constructed in such a way, for a chain saw has a low weight but nevertheless has sufficient strength with respect to bending loads, compressive loads, wear and torsional loads. If such guide bars are used for their intended purpose, they have proven successful in practice. However, overloads result in damage to the composite made up of the main bar body and the fiber composite material, and this can result in the guide bar failure.

SUMMARY OF THE INVENTION

It is an object of the invention to develop a guide bar of the generic type such that the composite made up of the fiber composite material and the main bar body made of steel also withstand high loads without permanent damage occurring to the guide bar.

The insert made of fiber composite material includes a central layer made of at least one fiber layer, the fibers of which are located at an angle to the longitudinal axis of the guide bar. At least two fiber layers having fibers oriented in the longitudinal direction of the guide bar are placed on both sides of the central layer, wherein the insert made of fiber composite material is covered outwardly by a woven fabric.

This multilayer structure with partially different orientation of the fibers results in a highly loadable composite made up of the main body and the fiber composite material, wherein the overall weight of the guide bar is low. The unidirectional orientation of the fibers in the longitudinal direction of the guide bar gives the constructed guide bar high stability with respect to bending loads. High stability with respect to torsional loads is brought about advantageously by the fibers located at an angle to the longitudinal axis of the guide bar, in particular the fibers of the central layer.

Preferably, the central layer includes at least two fiber layers, the fibers of which are located at an angle of about 90° to one another. Expediently, the angle between the longitudinal axis of the guide bar and the fibers of the fiber layer of the central layer is in this case selected such that it is between 30° and 60°, in particular about 45°.

In a particular embodiment of the invention, the fiber layer of the central layer is formed from a woven fabric, the warp threads and weft threads of which are at an angle to the longitudinal direction of the guide bar.

In an embodiment of the invention, the central woven fabric and in each case one fiber layer arranged on its two sides are formed as a central component that is bonded in one piece.

Toward the outside, the insert is covered by the woven fabric, which is expediently arranged in the plane of the bar side. In this case, the outer woven fabric and at least one fiber layer arranged on its inner side forms an outer component that is bonded in one piece. Expediently, the outer component includes two fiber layers that are bonded firmly together.

In order to obtain a high packing density of the fiber layers, provision is made for a filling component made of fiber layers to be arranged between the central component and the outer component, the filling component preferably being made of a plurality of fiber layers that are bonded together in one piece. The fiber layers are in this case bonded together by resin.

In a further embodiment of the invention, a fiber layer has rovings that extend in the longitudinal direction of the guide bar. Bundles, strands or multifilament yarns made of filaments arranged in parallel are designated rovings.

The woven fabric, in particular the woven fabric of the central layer, is in the form of a woven having a plain weave. It may also be advantageous to configure the woven fabric, in particular the outer woven fabric, as a woven having a twill weave.

In principle, fibers, in particular long fibers made of different materials, can be used. Preferably, use is made of carbon fibers, in particular in the form of carbon fiber mats and/or carbon fiber fabrics. In this case, all of the layers have fibers made of the same material; it may be practical to use fibers made of different materials in the different fiber layers of fiber mats and fiber fabrics.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
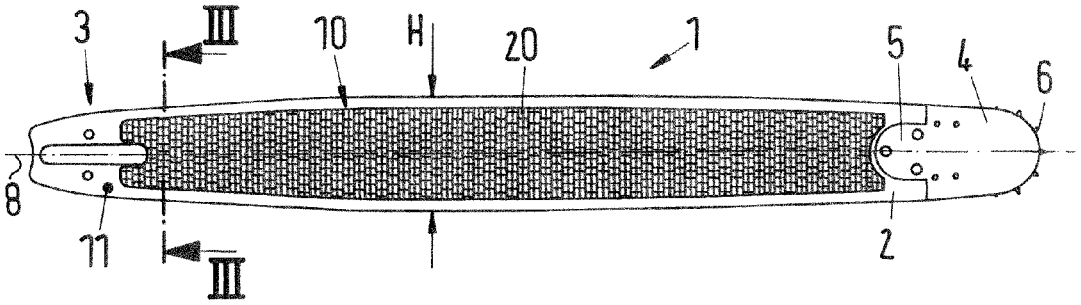
FIG. 1 is a side view of a guide bar according to the invention having an insert made of a composite material.

FIG. 1 shows a guide bar 1, as is used in chain saws and is described for example in U.S. Pat. No. 4,903,410. The guide bar 1 includes a main body 2, which is formed at one, rear end with a connection section 3 and at its other, front end has a bar tip 4. The bar tip 4, provided as a separate component, is secured to the main body 2 of the guide bar 1 by a joining section 5. A sprocket return wheel 6 is held in a rotatable manner in the bar tip 4.

Figure 2:
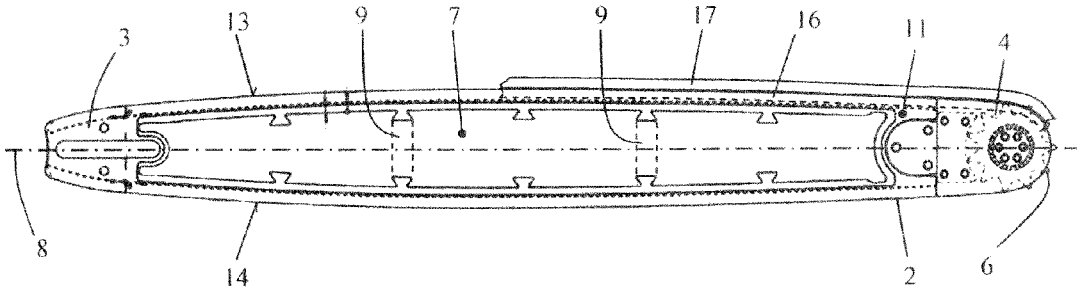
FIG. 2 is a side view of a main body of the guide bar according to FIG. 1.

As can be seen from FIG. 2, a cutout in the form of a window 7 is provided in the main body 2 of the guide bar 1. The window 7 extends in the direction of the longitudinal axis 8 of the guide bar 1 between the connection section 3 and the bar tip 4 in the embodiment shown. The window 7 furthermore extends transversely to the longitudinal axis 8 over a major part of the height H of the guide bar 1. It may be advantageous to configure the window 7 in a multi-part manner, for example to divide it up by way of crosspieces 9, extending transversely to the longitudinal axis 8, of the main body 2, these being indicated by dashed lines in FIG. 2.

Figure 3:
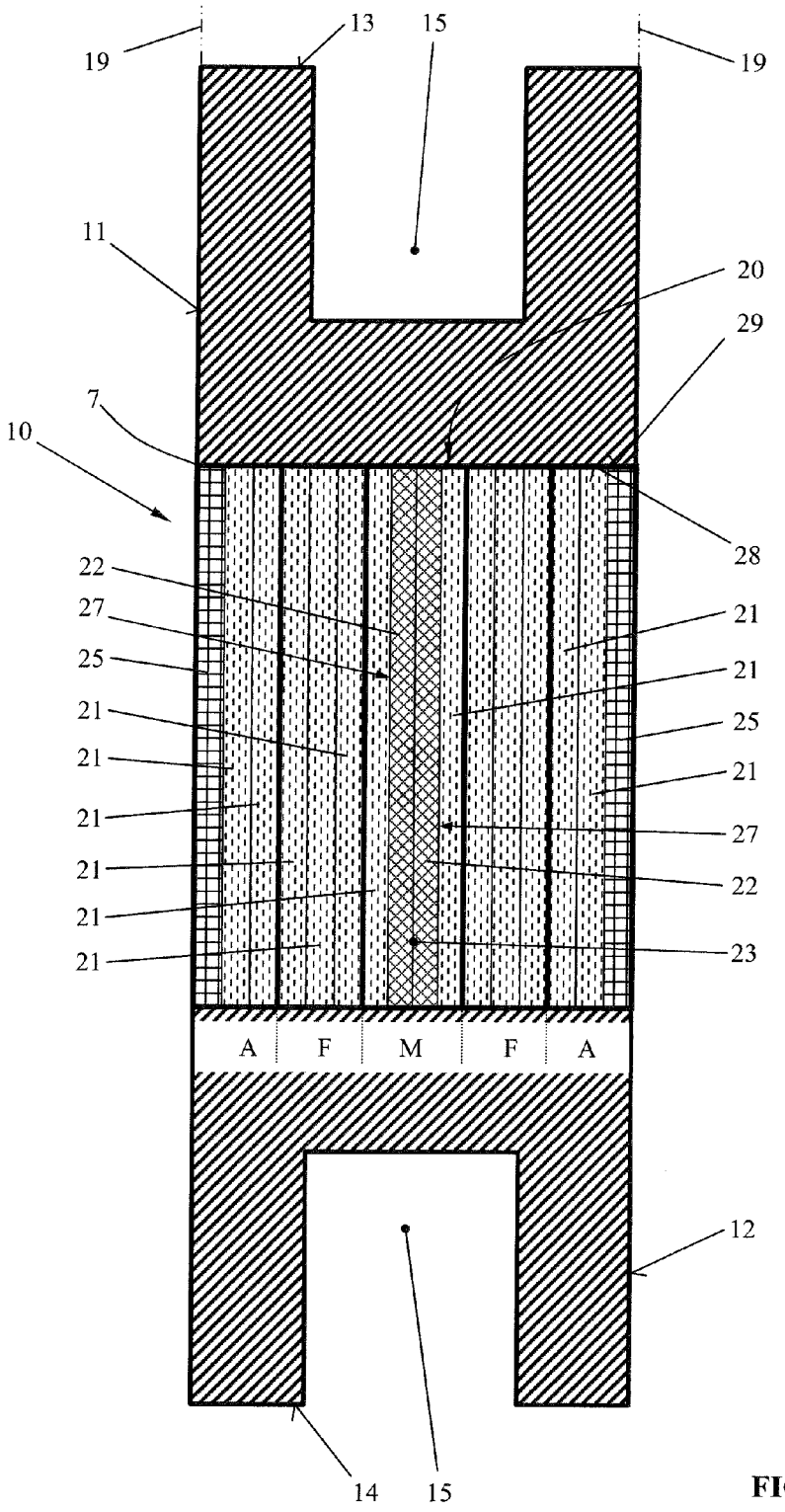
FIG. 3 shows a section through a guide bar having an insert made of composite material along the line in FIG. 1.

The flat main body 2—which is preferably made of a steel plate—of the guide bar 1 has a first outer bar side 11 and a second outer bar side 12 (FIG. 3). Incorporated on its outer peripheries 13 and 14 is a guide groove 15, which is configured to guide drive links 16, indicated schematically in FIG. 2, of a saw chain 17 on the main body 2 of the bar.

The window 7—which is embodied in one piece in the embodiment shown—is filled with an insert 10 made of a fiber composite material 20 (FIG. 1). FIG. 3 reproduces a schematic illustration of a section along the line in FIG. 1.

The insert 10 made of the fiber composite material 20 has a plurality of fiber layers 21 bonded by resin, wherein a central layer 23 is formed from at least one fiber layer 22, the fibers of which are at an angle 24 (FIG. 7) to the longitudinal axis 8 of the main body 2 of the guide bar 1.

Figure 7:
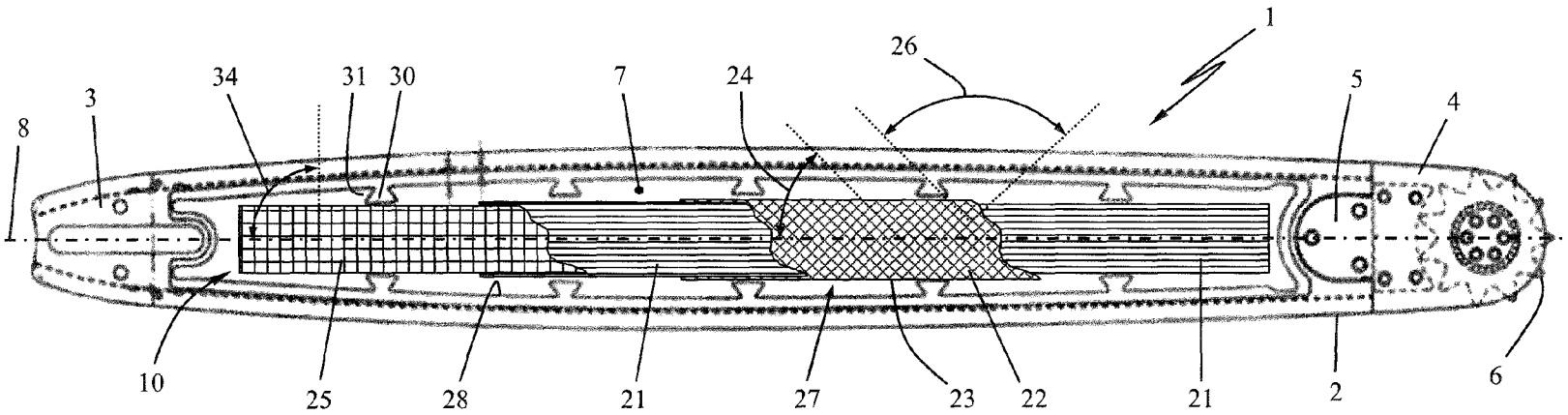
FIG. 7 is a side view of the guide bar according to FIG. 2 with schematically illustrated fiber layers of the insert; and, FIG. 8 is a side view of the main body according to FIG. 2 with rovings indicated in the insert.

In a particular configuration of the invention, the angle 24 between the longitudinal axis 8 of the guide bar 1 and the fibers of the fiber layer 22 is about 30° to 60°, in particular about 45°, as is illustrated in the center of FIG. 7. It may be practical to provide carbon fibers or carbon threads in individual carbon fiber layers (21, 22) and/or in the carbon fiber fabric 25, the carbon fibers or carbon threads being at an angle 34 of about 90° to the longitudinal axis 8 of the main body 2 (FIG. 7).

Arranged on both sides of the central layer 23 are at least two fiber layers 21, which have fibers oriented in the direction of the longitudinal axis 8 of the guide bar 1. In a particular configuration of the invention, the central layer 23 is made of at least two fiber layers 22, wherein the fibers of one fiber layer 22 are at an angle 26 to the fibers of the other fiber layer. The angle 26 is about 60° to 120°, in particular 90°.

In an embodiment of the invention, the fiber layers 22 of the central layer 23 can be made of a woven fabric 27, as is reproduced schematically in FIG. 7. The warp threads and the weft threads of the woven fabric 27 are at an angle 26 to one another, the angle 26 expediently being 90°.

The fiber layers 21, which are arranged on both sides of the central layer 23 within the window 7, are covered outwardly by a woven fabric 25. The woven fabric 25 that outwardly covers the inner fiber layers 21 is preferably located approximately in the plane 19 of the corresponding bar side 11 or 12.

As FIG. 3 shows, the insert 10 is made of subassemblies which, after being placed in the window 7 in the main body 2, are cured under pressure and a temperature of about 95°, wherein resin can additionally be introduced. During this baking of the composite material, the resin bonded to the fiber layers is—as long as prepreg material is used—liquefied, so that the subassemblies melt to form a one-piece insert 10 within the window 7.

It can also be advantageous to initially place the individual resin-less fiber layers and the woven fabric in the main body and to saturate them in their installed position in the main body with a premixed liquid resin and binder. Advantageously, this already takes place in the mold. Finally, resin and curing agent are fed to the temperature-controlled mold under pressure and the composite material is cured.

Figure 6:
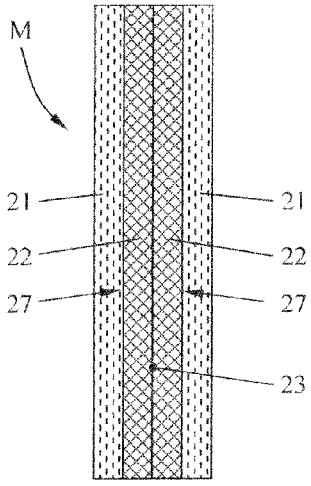
FIG. 6 shows a section through a central component of the insert according to FIG. 1.

In the exemplary embodiment, the central layer 23 is part of a central component M, which includes as a whole four fiber layers (21, 22) (FIG. 6). Two central fiber layers 22, the fibers of which are at an angle 26 of about 90° to one another and form an angle 24 of 45° with the longitudinal axis 8, are each covered on their outer sides with a fiber layer 21 having fibers that are oriented unidirectionally in the direction of the longitudinal axis 8 of the guide bar 1. In this case, the central fiber layers 22 expediently are made of a woven fabric 27, in particular of a woven fabric having a plain weave. This has proven to be advantageous, since it can easily be penetrated by the resin.

Figure 5:
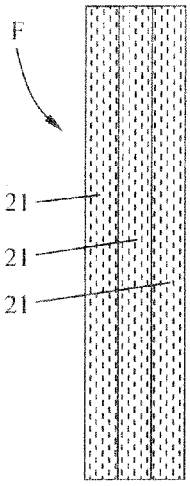
FIG. 5 shows a section through a filling component of the insert according to FIG. 1.

On both sides of the central component M, filling components F are arranged in the window 7. The filling components are formed, in the embodiment shown, of three fiber layers 21 that are bonded together (FIG. 5). The fibers of the fiber layers 21 in the filling component F are oriented in the direction of the longitudinal axis 8 of the main body 2 (FIG. 7). The fibers of the fiber layers 21 are oriented unidirectionally in the direction of the longitudinal axis 8 of the main body 2.

Figure 4:
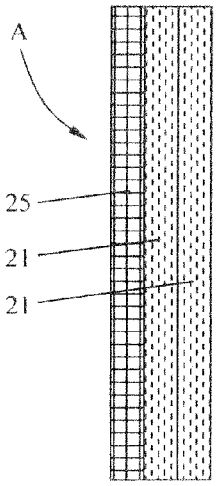
FIG. 4 shows a section through an outer component of the insert according to FIG. 1.

As FIG. 3 shows, the filling components F are covered by outer components A, which—in the embodiment shown—are made of three fiber layers. An outer fiber layer is formed by a woven fabric 25, which is expediently a fabric having a twill weave. Provided between the woven fabric 25 and the filling component F is at least one further fiber layer 21; in the exemplary embodiment, the outer component A has two fiber layers 21, which form the one-piece outer component A together with the woven fabric 25 (FIG. 4).

In a simple configuration of the insert 10, the insert 10 is fixed in the window 7 by way of an adhesive bond which is provided between the inner periphery 28 and the periphery 29 of the insert 10. The adhesive bond ensures that the insert 10 is bonded intimately and robustly to the main body 2.

In an embodiment of the invention, provision may be made for protrusions 30 to be formed on the inner periphery 28 of the window 7. The protrusions 30 expediently are formed in one piece with the main body 2 and project into the window 7 transversely to the longitudinal axis 8. The protrusions 30 have undercuts 31 and an approximately mushroom-like shape in side view as per FIGS. 7 and 8. The carbon fiber mats and carbon fiber fabrics have recesses corresponding to the protrusions 30, such that the assemblies made of the outer component A, filling component F and central component M have corresponding cutouts. As a result, the inner periphery 28 of the guide bar 1 is intimately interlocked with the insert 10. As a result, a form-fitting bond between the insert 10 and the main body 2 of the guide bar 1 is produced transversely to the longitudinal axis 8. The cutouts or recesses are punched out of the two-dimensional material, this being cost-effective and easy.

Figure 8:
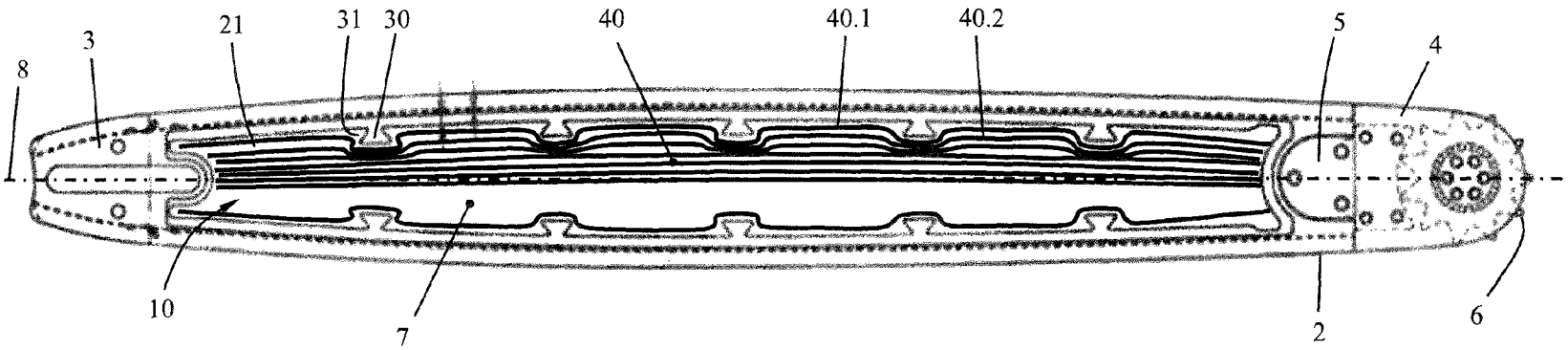

Expediently, rovings are incorporated in the fiber layers (21, 22), the rovings being made of a bundle, a strand or a multifilament yarn of carbon. As is illustrated in FIG. 8 using the example of a fiber layer 21, the rovings 40 extend continuously from the connection section 3 of the main body 2 to the bar tip 4. If protrusions 30 are provided, the rovings (40.1, 40.2) extending close to the inner periphery 28 are guided around the protrusions 30, so that a roving 40 is not interrupted between the connection section 3 and the bar tip 4. Thus, fraying of the fiber mats in the region of the protrusions can be avoided. The continuous rovings furthermore result in very good stability of the insert 10 made of fiber composite material.

The fiber layers (21, 22) can advantageously be formed from carbon fibers, and are in particular in the form of carbon fiber mats or carbon fiber fabrics. In this case, the fibers in a mat or layer are preferably oriented unidirectionally. Advantageously, the carbon fiber layers or the fibers of the carbon fiber layers are pre-fixed with resin, that is, preimpregnated with resin, or form a semifinished product also known as a "prepreg". After the prepreg subassemblies have been positioned, the arrangement is cured for a predetermined time at a suitable temperature with addition of resin and curing agent. It may also be expedient to embed the fibers of the carbon fiber layers in an uncured thermosetting plastics matrix.

It may be advantageous to produce the carbon insert from an endless filament, in that the filament is placed on a carrier and stitched in place. The thickness of the insert to be inserted into the main body is achieved by superimposing and repeatedly stitching in place the introduced endless thread. The insertion can also take place directly into the window of the main body.

It is understood that the foregoing description is that of the preferred embodiments of the invention and that various changes and modifications may be made thereto without departing from the spirit and scope of the invention as defined in the appended claims.

What is claimed is:

1. A guide bar for a chain saw having a saw chain including drive members, the guide bar comprising:

an elongated base body made of steel, defining a longitudinal axis and having first and second flat bar sides and two opposite lying peripheral edges defining a guide groove configured to accommodate the drive members of the saw chain therein;

said base body having an elongated window formed therein between said two peripheral edges;

an insert filling said window and being made of a fiber composite material including a plurality of fiber layers mutually bonded by resin;

at least one of said plurality of fiber layers being configured as a central layer having fibers disposed at an angle to said longitudinal axis;

at least two of said plurality of fiber layers being disposed on each side of said central layer as outer fiber layer units with the fibers of each of the fiber layers of each of said outer fiber layer units being aligned in a direction of said longitudinal axis; and, said insert further including first and second fabrics outwardly covering respective ones of said outer fiber layer units.

2. The guide bar of claim 1, wherein said central layer includes at least two fiber layers having respective sets of fibers disposed at an angle of 90° to each other.

3. The guide bar of claim 1, wherein said angle between fibers of said central layer and said longitudinal axis is 45°.

4. The guide bar of claim 1, wherein said central layer has a fiber layer configured of a fiber fabric having weft and warp threads disposed at an angle to said longitudinal axis of said base body.

5. The guide bar of claim 4, wherein said fiber fabric of said central layer is a central fiber fabric; and, one fiber layer of each of said outer fiber layer units adjoins a corresponding side of said central fiber fabric to conjointly form a one-piece bonded central component.

6. The guide bar of claim 4, wherein said fiber layer of said central layer is a fiber fabric having a plain weave.

7. The guide bar of claim 1, wherein:

said first flat bar side defines a first plane;

said second flat bar side defines a second plane;

said first fabric is disposed in said first plane; and, said second fabric is disposed in said second plane.

8. The guide bar of claim 7, wherein:

said first fabric and an adjacent one of said plurality of fiber layers form a one-piece bonded first outer component; and, said second fabric and an adjacent one of said plurality of fiber layers form a one-piece bonded second outer component.

9. The guide bar of claim 8, wherein said first and said second outer components each include two mutually fixedly bonded ones of said plurality of fiber layers.

10. The guide bar of claim 1, wherein:

said central layer has a fiber layer configured of a fiber fabric having weft and warp threads disposed at an angle to said longitudinal axis of said base body;

said fiber fabric of said central layer is a central fiber fabric;

one fiber layer of each of said outer fiber layer units adjoins a corresponding side of said central fiber fabric to conjointly form a one-piece bonded central component;

said first flat bar side defines a first plane;

said second flat bar side defines a second plane;

said first fabric is disposed in said first plane;

said second fabric is disposed in said second plane;

said first fabric and an adjacent one of said plurality of fiber layers form a one-piece bonded first outer component;

said second fabric and an adjacent one of said plurality of fiber layers form a one-piece bonded second outer component; and, wherein said guide bar further comprises a first filler component arranged between said one-piece bonded central component and said one-piece bonded first outer component.

11. The guide bar of claim 10, wherein said guide bar further comprises a second filler component arranged between said one-piece bonded central component and said one-piece bonded second outer component.

12. The guide bar of claim 10, wherein said first and said second filler components each include several mutually bonded ones of said plurality of fiber layers.

13. The guide bar of claim 1, wherein one of said plurality of fiber layers has rovings extending in the direction of said longitudinal axis.

14. The guide bar of claim 1, wherein said first and said second fabrics are fabrics having a twill weave.

15. The guide bar of claim 1, wherein said fibers are carbonfibers.

* * * * *